United States Patent [19]

Guala

[11] 3,937,348

[45] Feb. 10, 1976

[54] SECURITY BOTTLE CLOSURE DEVICE

[75] Inventor: Piergiacomo Guala, Alessandria, Italy

[73] Assignee: Angelo Guala S.p.A., Alessandria, Italy

[22] Filed: Mar. 5, 1975

[21] Appl. No.: 555,902

[30] Foreign Application Priority Data

Mar. 7, 1974 Italy ..... 67627/74

[52] U.S. Cl. ..... 215/252

[51] Int. Cl.[2] ..... B65D 41/34; B65D 41/36; B65D 41/38

[58] Field of Search ..... 215/252, 7, 258, 253

[56] References Cited

UNITED STATES PATENTS

| | | | |
|---|---|---|---|
| 3,025,989 | 3/1962 | Williams | 215/252 |
| 3,850,328 | 11/1974 | Guala | 215/252 |

*Primary Examiner*—George T. Hall

*Attorney, Agent, or Firm*—Sughrue, Rothwell, Mion, Zinn & Macpeak

[57] ABSTRACT

A closure device with a guarantee seal for bottles of the type having a screw thread and a radial shoulder, formed as by a collar or thickened portion, on the neck thereof is disclosed. The closure device comprises a cap with an elongate skirt to the rim of which is connected, by a frangible connection, a tubular anchoring member which carries a plurality of axially extending resilient tongues which, when the device is in position, latch under the radial shoulder to prevent removal of the anchoring member. The cap itself thus cannot be removed without breaking the guarantee seal formed by the frangible connection between the skirt of the cap and the anchoring member. To prevent breakage of the frangible connection while the closure device is being fitted the inner face of the skirt and the outer faces of the tongues are provided with cooperating ribs and grooves so that torque can be transmitted directly from the cap to the tongues, bypassing the frangible connection.

2 Claims, 6 Drawing Figures

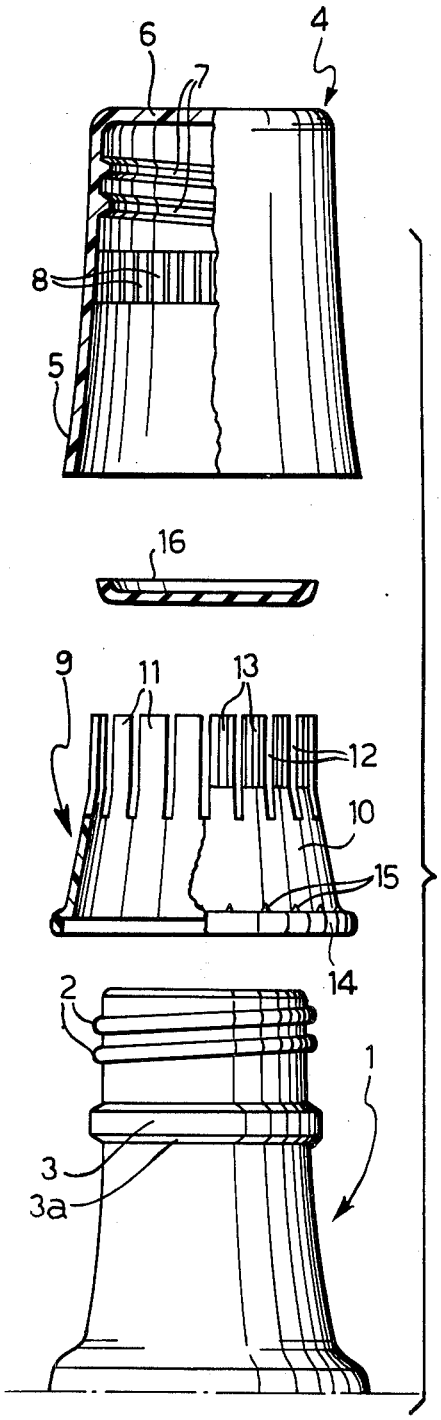
FIG. 1
FIG. 2
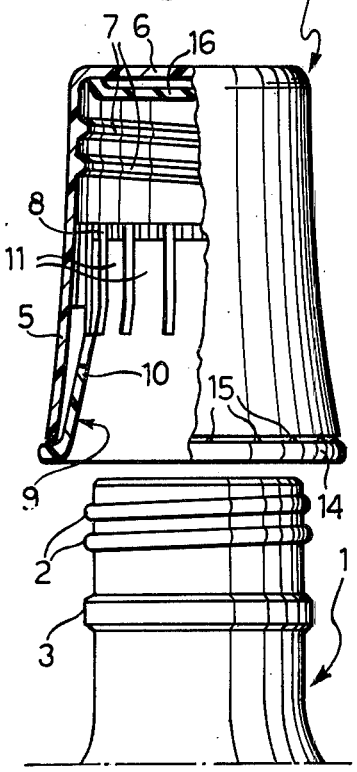

SECURITY BOTTLE CLOSURE DEVICE

The present invention relates to closure devices for bottles, and particularly to closure devices of the type having a guarantee seal. Known closures of this type comprise a cap having an internal screw thread by means of which it is screwed onto a screw threaded part of the neck of a bottle, the neck being also provided, below the thread, with means forming a radial shoulder, such as an external annular ridge, an annular groove or a thickened portion of the neck. The cap includes a tubular anchoring member axially spaced from the threaded portion of the cap, and connected thereto by means of a frangible connection. The anchoring member has an internal diameter slightly greater than the outer diameter of the said annular shoulder of the neck of the bottle except for a part at its end where there are a number of resilient tongues extending inwardly and away from the rim of the cap, and so shaped that their inner edges lie in a circle the diameter of which is less than that of the annular shoulder on the bottle.

With this construction the cap and guarantee seal can be fitted in place simply by screwing the cap onto the threaded part of the neck of the bottle: as the cap moves towards the bottom of the bottle the tongues resiliently deform within the part of the cap engaged over the thread on the bottle and slide over the thread and the means forming the annular shoulder. After having been forced past the shoulder the tongues resume, as fas as possible, their undeformed position with a part thereof facing the said annular shoulder on the neck of the bottle. It will be appreciated that reference herein to "upper" and "lower" components or directions are intended to refer to the orientation of components on a bottle in a normal, upright, position. Subsequent upward movement of the tongues along the neck of the bottle and thus also movement of the tubular anchoring member from which they project is prevented by the engagement of the tongues with the annular shoulder, and unscrewing of the cap, with consequent opening of the bottle, can only be effected by also causing breakage of the connection between the tubular fixing element and the cap in the weakened region by which they are joined. Breakage of this weakened region provides evidence that there is no longer a guarantee as to the quality and quantity of liquid contained in the bottle.

In one known bottle closure device of this type (described for example in German Pat. No. 1,139,403), a cap is provided with an elongate tubular skirt with a weakened region part way along it formed by a plurality of circumferential slots separated by narrow connector portions which link the body of the cap to the elongate skirt. A separate anchoring member having a plurality of resiliently deformable tongues is lodged between the skirt and the neck of a bottle. The resilient tongues are arranged in a circle and project inwardly and upwardly from an annular collar which forms the body of the anchoring element. The free inner ends of the tongues have a radially outwardly projecting lip and the relative sizes are such that the inner diameter of the annular collar is greater than the diameter of the annular ridge on the neck of the bottle on which the closure is to be used, and the diameter of the circle formed by the inner ends of the tongues is smaller than the diameter of the annular shoulder.

In use of the closure device the lips on the ends of the tongues project into the circumferential slots in the skirt to permit the radially outward flexing of the tongues necessary to get the locking member onto the neck of the bottle past the annular shoulder thereof.

This known device has, however, the disadvantage of using a separate intermediate anchoring member which means that the components have to be made with great accuracy in order to ensure satisfactory operation. Having more than one component makes the assembly of the device rather difficult. Another disadvantage of this known device is that, by carefully gripping the radially outwardly directed lips through the circumferential slots in the skirt it is possible to ease the locking member back over the annular shoulder on the neck of the bottle. By this procedure it is possible to unscrew the cap, and the tubular extension forming the skirt, from the neck of the bottle without breaking the frangible connector portions joining the skirt with the body of the cap, thereby making it possible to re-use the closure device having removed or altered the liquid within the bottle, and the cap will show no traces of its removal from the neck of the bottle.

A further disadvantage of this known device is the fact that a torque is transmitted between the cap and the tubular extension through the frangible connector portions when the cap is first screwed onto the neck of the bottle. There is thus a risk of breaking these connector portions and making the device useless even before it is properly fitted to the neck of the bottle.

The object of the present invention is to produce a closure device of the general type described above which is free of the above mentioned disadvantages of known such closure devices, and in which there are fewer components: this latter makes assembly of the closure onto a bottle easier. In embodiments of the present invention the shape of the cap and the tubular anchoring member are such as to ensure that the weakened region or frangible connection which joins them is not subjected to torsion forces likely to break the connection when the device is first fitted to a bottle.

According to the present invention, there is provided a closure device for bottles of the type having a screw thread at or adjacent the end of the neck thereof and means forming a radial shoulder facing away from the mouth of the bottle, comprising a cap with an internal screw thread having an elongate skirt with an internal screw thread for cooperation with the screw thread on the neck of a bottle, and a tubular anchoring member within the skirt of the cap, below the screw thread thereof, and connected to the skirt of the cap by a frangible connection, the said tubular anchoring member having an internal diameter which is greater than the outer diameter of the said radial shoulder on the neck of the bottle, and a plurality of resilient tongues extending away from the rim of the skirt and shaped such that their free ends lie in a circle the diameter of which is less than the outer diameter of the radial shoulder, characterised in that the tubular anchoring member is formed at the end thereof opposite that from which project the said resilient tongues with a radially outwardly projecting flange which is joined to the rim of the skirt of the cap by means forming the said frangible connection of the cap to the tubular anchoring element, in that the radially outer faces of the tongues have longitudinal ribs, and in that a portion of the inner face of the skirt of the cap is provided with a plurality of axial ribs for cooperation with the ribs on the radially outer faces of the tongues when the tongues are displaced radially outwardly as the device is first screwed onto the neck of a bottle until the ends of the tongues engage against the said radial shoulders, in order to transmit to the anchoring member the torque applied to the cap upon securing the device onto the neck of a bottle.

One advantage of embodiments of closure device according to the invention is that they can be made of only two parts which can be assembled and joined to each other with great ease. For this purpose the radial flange of the tubular anchoring member is provided with a plurality of small projections. Upon assembly the tubular anchoring member is fitted into the cap so that the lower rim of the skirt of the cap rests on these protrusions, and connection of the projections to the rim of the skirt is effected by electronic welding.

The engagement of the axially extending radially outer ribs on the tongues, into the grooves formed between the ribs on the cap, which takes place when the tongues are spread out while passing over the threads of the neck of the bottle, and particularly, if the bottle is so formed, while passing over the radial annular ridge of the neck of the bottle as the cap is being screwed on, ensures the transmission of the torsional forces from the cap to the tubular fixing element at a point spaced from the weakened region formed by welding the said projections on the flange of the tubular anchoring member to the skirt of the cap.

Another advantage of embodiments of the present invention is that the annular ridge of the neck of the bottle (in bottles which have one), could serve as a rest for the cap when it is screwed on to reclose the bottle subsequent to the first opening thereof, and would thus prevent damage to the cap which could be caused by screwing it on with too much force.

Another known form of cap has a skirt, with the rim thereof resting on an external flange of a tubular anchoring member provided with tongues whose ends engage the lower face of an annular ridge formed on the neck of the bottle below the thread on which the cap engages when the cap is screwed onto the neck of a bottle or other container. Such a structure (as shown for example in U.S. Pat. No. 2,621,832) is, however, only provided for the purpose of limiting the travel of the cap in relation to the neck of the bottle, when unscrewing, to make possible the dispensing of the liquid from the bottle, through a hole in the top of the cap, and through a valve which is closed by being pressed against the mouth of the neck of the bottle when the cap is completely screwed down on the neck. In this structure the tubular anchoring element is firmly fixed by its outer peripheral flange to the lower rim of the skirt of the cap, and there is no weakened region which will be broken when the cap is unscrewed. In this known structure, therefore, the problem of having to prevent the torsion forces from being transmitted from the cap to the tubular anchoring member through a frangible connection formed by a weakened region connecting these two elements does not arise since there is no such weakened region.

Two embodiments of the invention will now be described in greater detail, by way of example, with reference to the accompanying drawings, in which:

FIG. 1 is a partly exploded and partly sectioned side view of one embodiment of a bottles closure device according to the present invention;

FIG. 2 is a partly sectioned side view showing the device after assembly and prior to being fitted to a bottle;

Figure 3:
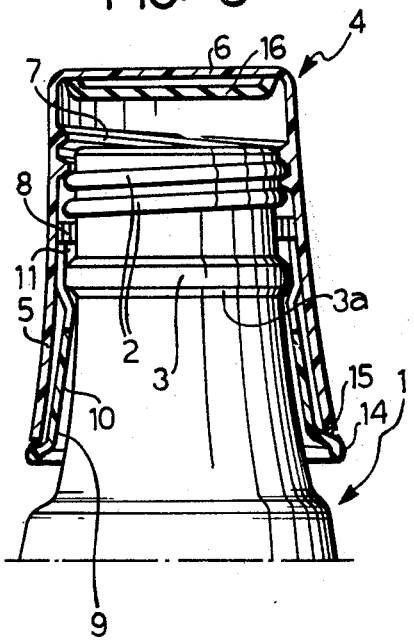
FIG. 3 is an axial section showing the device in the process of being fitted to a bottle.
Figure 6:
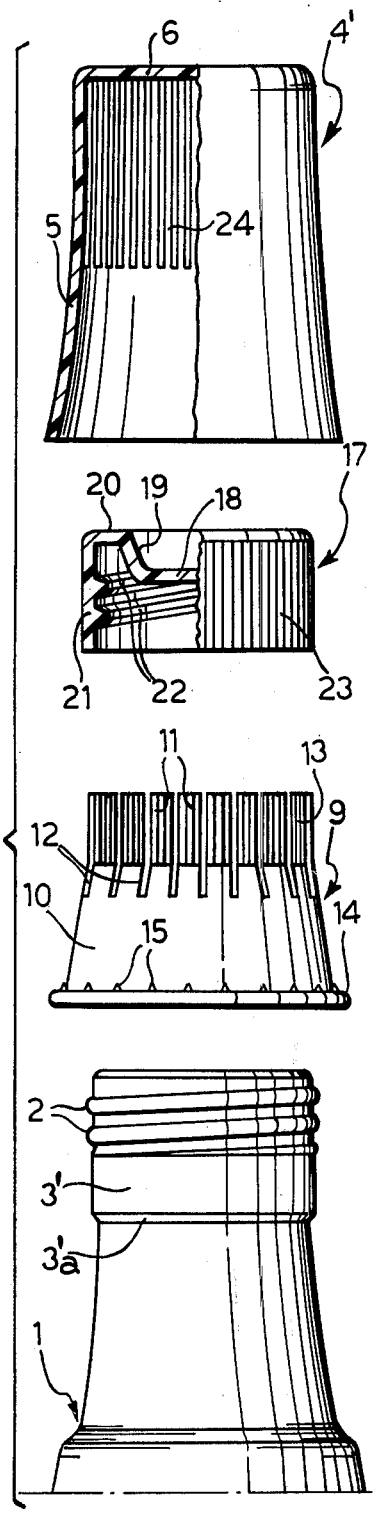
FIG. 6 is an exploded side view, partly in section, of a second embodiment of the invention.

Referring now to the drawings, bottles suitable for use with embodiments of the invention are those having a neck 1 provided at its upper end with a screw thread 2 and a radially outwardly projecting annular ridge 3 below the screw thread 2; this ridge has a lower radial face 3*a*. Alternatively, as shown in FIG. 6, the neck 1 may be formed with a thicker region 3' on which the screw threads 2 are formed and which has a radial shoulder 3'*a* facing away from the mouth of the bottle.

The embodiment of the invention shown in FIGS. 1 to 5 comprises a cap 4 moulded of plastics material and having an external bell shaped skirt 5 and a transverse end wall 6. Within the cap 4 the skirt 5 is provided with an internal screw threaded portion 7 adjacent the transverse wall 6, which engages the screw thread 2 of the neck of a bottle when the cap is fitted thereto. Below the screw thread 7 there is a portion of the inner wall of the skirt formed with axial ribs 8 forming between them a plurality of grooves.

The device also comprises a tubular anchoring member 9, again moulded of plastics material, in the form of a hollow truncated cone 10 the upper region of which is formed as a plurality of resilient strips or tongues 11 which extend parallel to one another and are separated by longitudinal slots 12 which extend into the truncated cone portion 10. The internal diameter of the wider or basal end of the truncated cone portion 10 is greater than the external diameter of the annular ridge 3 of the bottle and the internal diameter of the tongues 11 when unstressed, is less than the outer diameter of the annular ridge 3. The resilient strips 11 are provided on their radially outer faces with longitudinal ribs 13. At its base end the truncated cone portion 10 has a radially outwardly extending flange 14 which is provided on its upper surface with a plurality of small pointed projections 15.

Within the cap 4 there is fitted a seal 16 which, when the cap is fitted to a bottle, is pressed between the transverse wall 6 and the mouth of the bottle to ensure sealing of the bottle. The cap 4 and the tubular anchoring member 9 are fixed together after assembly by electronic welding of the lower rim of the skirt 5 of the cap to the projections 15 carried by the flange 14 of the tubular anchoring member 9, as will be seen in FIG. 2.

The device is fitted to the neck of a bottle simply by screwing the cap 4 onto the threaded portion 2 of the neck. While it is being screwed on to the bottle there is an intermediate stage (shown in FIG. 3) when the resilient strips 11 spread out and move over the ridge 3 of the neck of the bottle as the threads 7 of the cap start to engage the thread 2 of the neck. As a result of this the outer ribs 13 of the resilient strips 11 engage in the grooves between the ribs 8 in the cap 4, producing a temporary keying engagement between the two elements, in such a manner as to prevent torsion imparted to the cap, at this stage of mounting it on to the bottle, from causing accidental rupturing of the frangible connection between the rim of the skirt 5 and the basal flange 14 which constitutes the guarantee seal of the closure.

Figure 4:
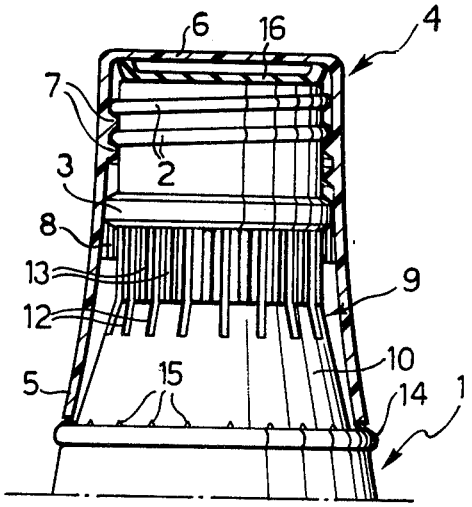
FIG. 4 is an axial section showing the device fitted to a bottle.
Figure 5:
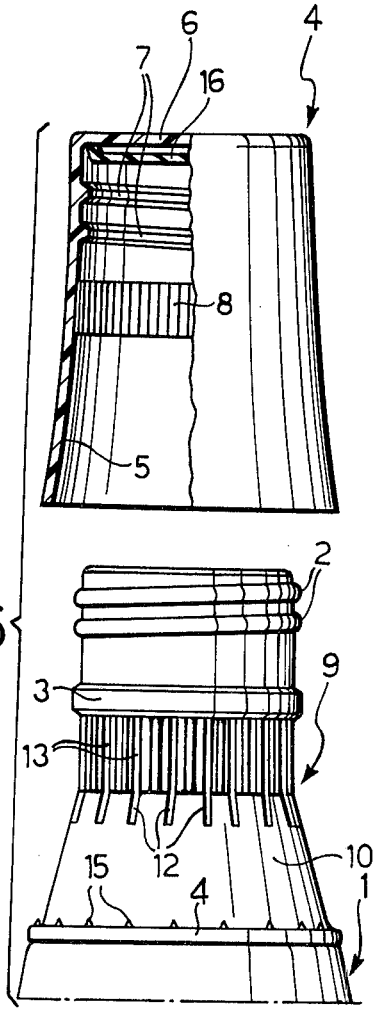
FIG. 5 is a partly sectioned side view showing the position when the bottle is first opened.

After passing over the ridge 3, as shown in FIG. 4, the resilient strips 11 of the tubular anchoring member 9 are free to spring back to their normal shape, they disengage from the ribs 8 and their ends engage under the radial face 3*a* of the ridge 3 thus ensuring the anchorage of the device, on the neck of the bottle. When first opening the bottle, as shown in FIG. 5, it is sufficient manually to grip the cap 4 and turn it in a direction which will unscrew it from the neck of the bottle. Because the tubular anchoring member cannot be pulled back over the annular ridge 3, being held in place by engagement of the ends of the strips 11 with the lower face 3*a* thereof, the welded projections are ruptured. The cap 4 can then be unscrewed readily and removed from the bottle, whilst the tubular anchoring member 9 remains permanently anchored to the neck of the bottle.

Reclosure of the bottle can be effected simply by screwing the cap 4 back onto the neck of the bottle to close its mouth in the normal way. Any number of subsequent opening and closing operations can be effected.

FIG. 6 illustrates a second embodiment in which the top of a cap 4' is fitted internally with a cup shaped insert 17 which acts as a closing plug in place of the sealing disc 16 of the embodiment of FIG. 1. This element includes a tubular part 21 having an inner screw thread 22 for engagement with the thread 2 of the neck of a bottle. The transverse upper wall of the insert 17 is formed in three parts, an annular outer part 20, an intermediate frustoconical part 19, and a central disc 18 which is axially displaced with respect to the annular outer part 20. The tubular wall 21 is slightly tapered towards the top, and is provided with external ribs 23 which are engageable with grooves 24 formed between longitudinal ribs on the inner face of the skirt 5 of cap 4' to ensure keying between the cap 4' and the insert 17. The grooves 24 of the cap 4' extend from the top thereof to a point half-way down so as to engage also with the ribs 13 of the resilient strips 11 of the tubular anchoring member 9 which is the same as the corresponding element described in relation to FIG. 1.

Various alternative constructions are envisaged. For example the tubular anchoring element could have, above the base flange, a hollow cylindrical part, having an inner diameter equal to or greater than the outer diameter of the annular ridge 3 of the neck of the bottle, and carrying on its top a crown of tongues or resilient strips inclined towards the axis of the tubular element, the tongues being of such a length that the tips of the free ends thereof can rest on a circular element having a diameter smaller than the outer diameter of the aforementioned ridge 3. With the base flange 14 there can be, in continuation, an additional length of tube, shorter than the cylindrical form; in other words the base flange 14 need not be formed right at the bottom of the anchoring body 9 but a short way up from the bottom.

What is claimed is:

1. In a closure device for bottles of the type having a screw thread at or adjacent the end of the neck thereof and means forming a radial shoulder facing away from the mouth of the bottle, said closure device comprising a cap having an elongate skirt, an internal screw thread on said skirt of said cap, said internal screw thread cooperating with the screw thread on the neck of a bottle when said cap is screwed thereon, and a tubular anchoring member fitted within said skirt of said cap below said internal screw thread thereof, said tubular anchoring member having an inner diameter greater than the outer diameter of the radial shoulder on the neck of a bottle on which the closure device is to be fixed, means forming a frangible connection between said tubular anchoring member and said skirt of said cap, and a plurality of resilient tongues on said tubular anchoring member, said resilient tongues extending away from said rim of said skirt of said cap and being shaped such that their free ends lie in a circle the diameter of which is less than the outer diameter of the radial shoulder on the bottle to which the cap is to be fixed, so as to engage there against, the improvement wherein:

said tubular anchoring member is formed at the end thereof opposite that from which project said resilient tongues with a radially outwardly projecting flange which is joined to said rim of said skirt of said cap by said means forming said frangible connection of said cap to said tubular anchoring member, the radially outer faces of said resilient tongues of said tubular anchoring member have longitudinal ribs extending therealong, a portion of the inner face of said skirt of said cap is provided with a plurality of axial ribs for cooperation with said ribs on said radially outer faces of said tongues of said tubular anchoring member when said tongues are displaced radially outwardly as the said closure device is screwed for the first time onto the neck of the bottle onto which it is to be fixed, until the ends of said tongues engage against said radial shoulder, whereby to transmit to said anchoring member the torque applied to said cap upon screwing said closure device onto said neck of said bottle.

2. The closure device of claim 1, wherein said cap carries a cup shaped insert having:

a tubular wall portion a transverse wall portion closing one end of said tubular wall portion, a screw thread on the inner face of said tubular wall portion for cooperation with said thread on the neck of a bottle onto which said closure device is to be fixed a plurality of longitudinal ribs on the outer face of said tubular wall portion for cooperation with the internal longitudinal ribs on the cap, which ribs extend from a point adjacent the top of said cap to a point midway along the skirt thereof, for cooperation with said ribs on said resilient tongues of said tubular anchoring member.

* * * * *